United States Patent [19]

Goldfarb et al.

[11] 3,933,354

[45] Jan. 20, 1976

[54] REFLEX TESTING AMUSEMENT DEVICE

[75] Inventors: Adolph E. Goldfarb, Tarzana; Erwin Benkoe, Encino, both of Calif.

[73] Assignee: Brunswick Corporation, Skokie, Ill.

[22] Filed: Sept. 18, 1974

[21] Appl. No.: 507,249

[52] U.S. Cl. ..... 273/1 E; 35/22 R; 272/76

[51] Int. Cl.[2] ..... A63B 69/00

[58] Field of Search ..... 273/1 E, 102.2; 35/22 R; 272/76

[56] References Cited

UNITED STATES PATENTS

| | | | |
|---|---|---|---|
| 2,984,017 | 5/1961 | Pask | 35/22 R X |
| 3,024,020 | 3/1962 | Alton | 35/22 R X |
| 3,550,941 | 12/1970 | Spiro et al. | 273/102.2 R |
| 3,563,230 | 2/1971 | Gibbs et al. | 273/1 E X |
| 3,698,385 | 10/1972 | Low et al. | 35/22 R X |
| 3,802,098 | 4/1974 | Sampson | 273/102.2 X |

*Primary Examiner*—Paul E. Shapiro
*Attorney, Agent, or Firm*—John G. Heimovics; Sheldon L. Epstein; David S. Gutman

[57] ABSTRACT

An amusement device for use in simulating some of the essential competitive features of the Oriental martial arts such as karate, jujitsu and aikido is described. The preferred embodiment comprises a pair of identical pictures of combatants-one picture for each participant. The picture of each combatant camouflages a series of 10 lights, each light being located at a key attack/defense point on the combatant's body. At the start, one of these ten lights is turned on and the participants each try to hit their light to turn it off. The first "hit" causes both first lights to extinguish and a second light in each series to illuminate. The player to make the first "hit" gets a scoring credit for that "hit." The participants strike at the second light and so on as the 10 lights are sequenced in a pseudo-random order. The game continues for a predetermined period and at the end a winner is determined by comparing the number of "hits" made by the players. Modifications for a single-player game and a game which runs until a predetermined score is made are also taught.

43 Claims, 5 Drawing Figures

RUN
STOP
150
150R
150S
TO 172
A=B
162
152
154
156
158
160
140
142
146
144A
144B
114A
114B
118A
118B
112A
112B
110A
110B
116
A>B
A=B
A<B
108A
108B
104A
104B
106A
106B
132
122
124
126
128
130
120
102A
102B
100A
100B
NA1
NA2
NA3
NA4
NA5
NA6
NA7
NA8
NA9
NAØ
NB1
NB2
NB3
NB4
NB5
NB6
NB7
NB8
NB9
NBØ
1A
2A
3A
4A
5A
6A
7A
8A
9A
ØA
1B
2B
3B
4B
5B
6B
7B
8B
9B
ØB
5V
LØB
L9B
L8B
L7B
L6B
L5B
L4B
L3B
L2B
L1B
LØA
L9A
L8A
L7A
L6A
L5A
L4A
L3A
L2A
L1A
118A'
118B'
TO 150S
A=M
B=M
172
110A'
116A'
170
116B'
110B'

REFLEX TESTING AMUSEMENT DEVICE

FIELD OF THE INVENTION

This invention is in the field of amusement devices and, more particularly, is an amusement device for developing and testing reflexive responses used in karate, jujitsu, aikido and other related martial arts.

DESCRIPTION OF THE PRIOR ART

Many commercially successful amusement devices particularly those adapted for coin-operated service share a common characteristic; namely, they provide a simulated environment of an exciting, real-life competitive experience by offering just the essential features of competition. In the United States, ice hockey is a favorite sport in which competition centers around rapid offensive and defensive movements of two competing teams in shooting a high-speed puck into or away from a team goal. The spirit of ice hockey has been captured in an amusement device known as the AIR-HOCKEY Game sold by Brunswick Corporation and as described in U.S. Pat. No. 3,773,325 entitled Air Cushion Table Game.

The martial arts of karate, jujitsu and aikido are also attracting large participant and spectator interest in the United States and other countries in response to the growing awareness of Oriental culture. Accordingly, there is a need to provide an amusement and training device which is capable of capturing the essense of the competitive activity in a simple and low-cost manner. The essence of the Oriental martial arts is basically relaxation coordination balance speed.

The application of brute force is discouraged as the objective is to turn the advisary's strength against himself. Therefore, mechanical karate fighters, such as taught in U.S. Pat. No. 3,804,406 to Viscione on 16 APR 74 are unnecessarily complex and expensive. Accordingly, it is a principal object of this invention to provide a simple and low-cost amusement and training device which provides through simulation the essence of competition in the Oriental martial arts.

DESCRIPTION OF A PREFERRED EMBODIMENT

The amusement device of this invention is characterized by a picture, such as a display of a combatant, which is adapted to be hit by a participant, a series of lights mounted behind the picture and preferably each located at a different key attack or defensive position on the body of the combatant, means for detecting when the picture is hit in the vicinity of a light and means, responsive to these detecting means, for illuminating one of said lights and for controlling which light in the series is next illuminated when the picture is hit in the vicinity of an illuminated light. In order to demonstrate high performance or win against an opponent, the participant must rapidly extinguish each light in the series by touching or hitting the picture at the illuminated light. The lights are illuminated in a random or pseudo-random order which the participant cannot anticipate and therefore his relaxation, coordination, balance and speed are tested much the same as they would be in combat in determining the quality of his performance.

One embodiment of an amusement device of this invention is illustrated in the drawings in which.

Figure 1:
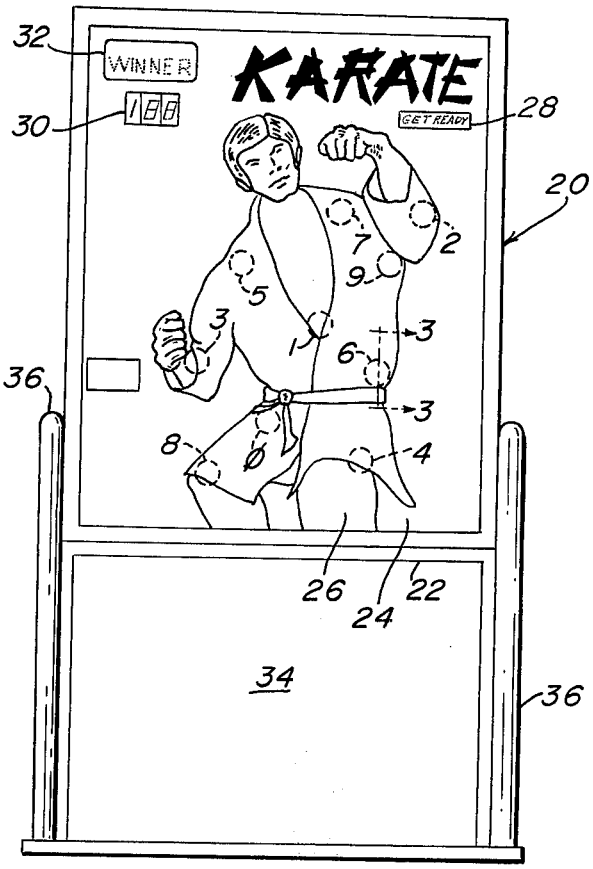
FIG. 1 is a front view of a coin-operated, two-player amusement device of the invention.

Turning to FIG. 1, it can be seen that the amusement device 20 appears to a participant as comprising a supporting frame 22 which encloses a near life-size picture 24 of a combatant 26. Located at key attack-/defense points on the body of the combatant 26 are a series of 10 lights 1, 2, 3, 4, 5, 6, 7, 8, 9, $\phi$ (drawn in dotted-line circles) mounted and camouflaged behind the picture 24 so that the positions of these lights can be seen only when they are illuminated. These lights are normally extinguished and therefore their positions cannot be seen until they are illuminated. Located near the head of the combatant are a "GET READY" light 28, a score indicator 30 and a "WINNER" light 32. The space 34 below the picture 24 is empty so that a participant can approach the picture 24 without having any obstruction blocking his feet.

Figure 2:
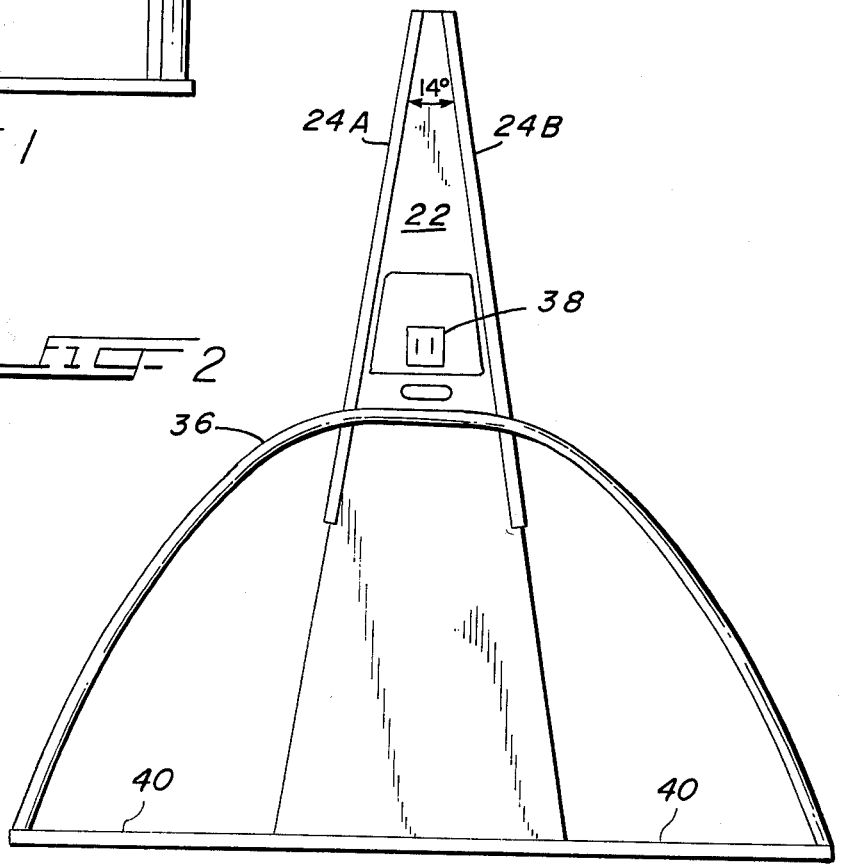
FIG. 2 is a side view of the amusement device of FIG. 1.

As shown in the side view of FIG. 2, the preferred embodiment of the amusement device is a two-player game. A first picture 24A is provided for a participant on the left and a second picture 24B is provided for the participant on the right. The pictures illustrate a combatant and are substantially identical in every important respect so that neither participant has an advantage. A first and a second series of 10 lights are mounted behind the surfaces of their respective pictures as described above. The lights in each series are mounted in identical postions behind the surfaces of their respective pictures and camouflaged so that the positions of the lights can only be seen when they are illuminated. Each picture is offset at approximately a $7^\circ$ angle with respect to a vertical plane to improve the optical illusion and to provide an edge at the top of the empty space 34—just above knee level—to discourage the participants from kicking the combatant 26. Thus, the angle between the pictures is approximately $14^\circ$. To further confine the participants to the game, a pair of side rails 36 are attached to the sides of the frame 22. One side of the frame 22 also contains coin slots 38 which the participants use to pay for their playing time.

The participants start the amusement device by walking onto opposite sides of base 40 and inserting a coin for each player in coin slots 38. When two coins are inserted, both sides of the amusement device are activated whereas only one side will be activated if only one coin is inserted. After the coins are registered by the coin accepter (not shown), "GET READY" lights 28 will glow for about five seconds. At the end of the five second period during which the participants can position themselves, the "GET READY" light 28 will go out simultaneously with the issuance of a noise (i.e., recorded grunting sound, bell or gong). One of the lights 1, 2, 3, 4, 5, 6, 7, 8, 9, $\phi$, will then be illuminated and each participant will try to strike, touch or hit his combatant at the illuminated point. As used herein, the word "hit" means any touching, striking or hitting of a picture 24 by a participant. In trying to hit the lighted portion of his combatant 26, a participant can use his hands, forearms, elbows or any other part of his body except his legs or feet (the latter being discouraged for safety reasons by the rails 36 and the 7° overhang above the empty space 34). The score indicator 30 on the side having the first "hit" will register a score and simultaneously the light that was illuminated will extinguish and another of the lights 1, 2, 3, 4, 5, 6, 7, 8, 9, $\phi$, will go on. The players again race to "knock out" the light which, in turn, causes still another light to come on. Because the lights are arranged to come on in a psuedo-random sequence, neither participant can anticipate which light is next. The result is that the player with the best relaxation, coordination, balance and speed will invariably win as he captures control through the use of circular attack/defense motions taught in the Oriental martial arts and sets the rhythm for the game. Skilled participants can establish a rhythm of about 2–3 "hits" per second which is very discouraging and upsetting to their opponents. With each "hit", a grunt, a moan or an "ug" (previously recorded) sounds from the combatant for the purpose of adding just a touch of realism.

Although the preferred embodiment is configured to run for a period of either 30 or 60 seconds and to use a pseudo-random sequence for illuminating lights 1, 2, 3, 4, 5, 6, 7, 8, 9, $\phi$, an alternative construction might include the use of a purely random sequence generator for the combatant lights or the use of a circuit to stop the game after a predetermined score had been achieved by one of the participants. In either case, the "WINNER" light 32 is illuminated at the end of the playing period to identify the victor.

Figure 3:
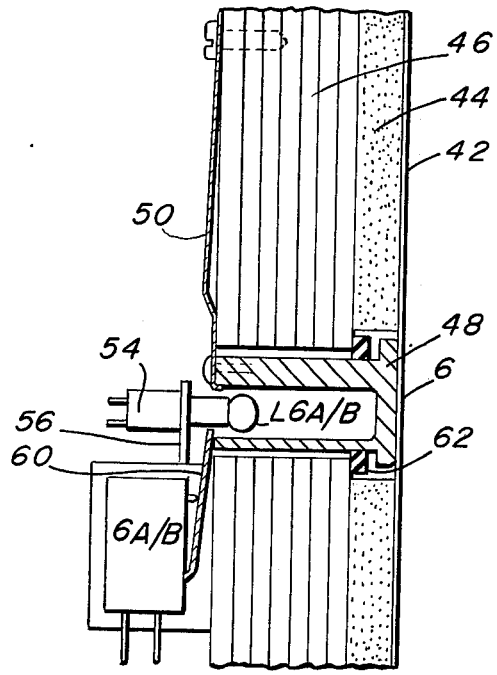
FIG. 3 is a sectional view showing the details of a light and button taken along section 3—3′ of FIG. 1.

Turning to FIG. 3, a cross-sectional view of the picture 24 taken through plane 3—3′ and light 6 can be seen. At the outer surface is a screened face sheet 42 of polyvinylchloride plastic, the inner surface of which is printed with the picture 24 of the combatant 26 and other desired indicia. Behind the face sheet 42 (except in the area of the lights 1, 2, 3, 4, 5, 6, 7, 8, 9, $\phi$) is a polyurethane foam pad 44 used to absorb impact energy and to prevent injury to the participants. The sheet 42 and the foam pad 44 are affixed to panel 46 made from ¾ inch plywood which is capable of withstanding repeated impact. The combination of the sheet 42, the foam pad 44 and the panel 46 is secured within the frame 22, preferably by hinges and pins to afford easy access and repair.

The lights, 1, 2, 3, 4, 5, 6, 7, 8, 9, $\phi$ are all identical with light 6 shown in FIG. 3. They comprise means for detecting when the picture 24 is hit in the vicinity of a light which, in this embodiment, include a button 48 biased forward against the picture 24 screen 42 by a spring 50 secured to the panel 46, (contiguous to a lightbulb L6A/B installed in a socket 54 attached to the panel 46 by a bracket 56 which is partially hidden) and microswitch 6A/B (either side) secured to the panel 46 and having its actuating arm 60 resting against the rear edge of the button 48 so as to be activated by the movement of the button. The button is made of a translucent material such as acrylic plastic and transmits the illumination from adjacent lightbulb L6 to the picture when the light is energized and illuminates the contiguous area of the combatant 26 on the face sheet 42. When the light is extinguished, the position of the light and the button behind the surface of the picture is hidden by the printing on the inside surface of the face sheet 42. When the participant strikes at the light 6, he pushes the shoulder of button 48 against foam plastic bumper ring 62 which serves to absorb shock and prevent injury to both the player and the game. In moving rearward, the rear edge of the button 48 forces the actuating arm 60 of the microswitch 6A/B back, thereby causing this normally-open switch to close and to send a signal indicating that the picture has been hit in the vicinity of its associated light. When pressure on the button 48 is released, bias spring 50 returns to button 48 to its normal position and the microswitch 6A/B again opens.

Figures 4, 5:
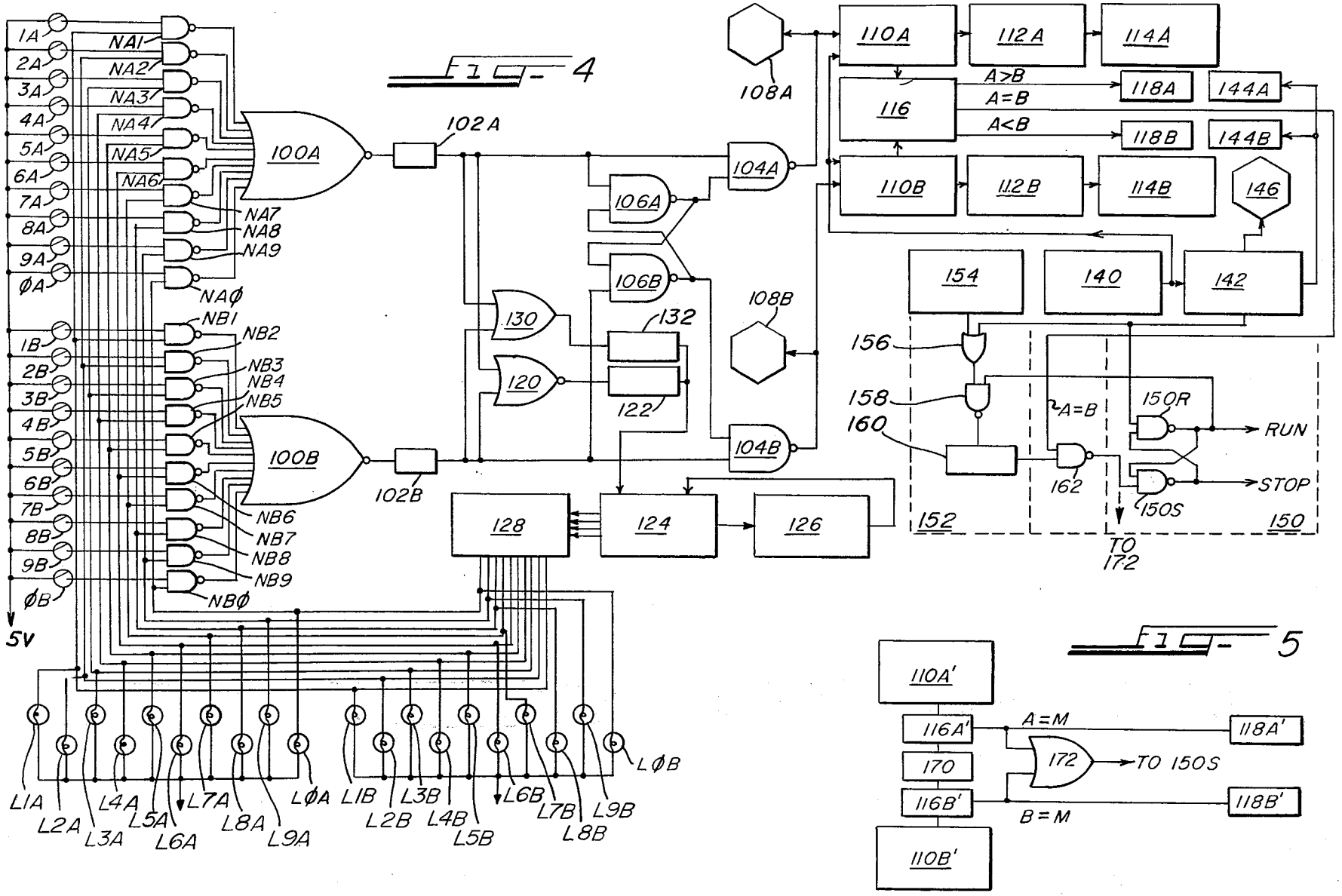
FIG. 4 is a simplified electronic schematic of the basic circuitry of the amusement device of FIGS. 1–3.
FIG. 5 is a simplified electronic schematic of a modified circuit of FIG. 4 adapted to stop play after a player has achieved a predetermined score.

In this embodiment, the electronic circuits, consituting means, responsive to the detecting means, for illuminating one of the lights and for controlling which light in each series is next illuminated when a picture is hit in the vicinity of an illuminated light are shown in FIG. 4. These means also include means for extinguishing a light in the vicinity of the area in which the picture 24 was hit. Two sets of microswitches 1A, 2A, 3A, 4A, 5A, 6A, 7A, 8A, 9A, $\phi$A, and 1B, 2B, 3B, 4B, 5B, 6B, 7B, 8B, 9B, $\phi$B are provided — one for each side. As described above, each switch has a corresponding light L1A, L2A, L3A, L4A, L5A, L6A, L7A, L8A, L9A, L$\phi$A and L1B, L2B, L3B, L4B, L5B, L6B, L7B, L8B, L9B, L$\phi$B. The armature of each of the switches is tied to a common bus energized to 5 volts. The pole of each switch is connected to one of the input terminals of its respective two-input NAND gate NA1, NA2, NA3, NA4, NA5, NA6, NA7, NA8, NA9, NA$\phi$ and NB1, NB2, NB3, NB4, NB5, NB6, NB7, NB8, NB9, NB$\phi$ (typically a 7400 integrated circuit). The other input to each of these NAND gates is connected to the "high" side of its respective light L1A. . . L$\phi$A and L1B. . . L$\phi$B. Thus no signal will issue from any of these NAND gates unless a switch corresponding to an illuminated light is closed. When such a condition occurs, a signal will issue from corresponding NOR gate 100A or 100B (typically 7430 integrated circuit). Since the signals coming from NOR gates 100A amd 100B are not uniform, they are fed into respective 100 MILLISECOND PULSE GENERATOR 102A or 102B (typically comprising a 555 integrated circuit in a pulse generating, monostable circuit). Thus when each participant strikes a lighted button, a respective 100 millisecond pulse is applied to one of the two inputs of respective NAND gates 104A and 104B (typically a 7400 integrated circuit). The other input of each of these NAND gates is connected to means for determining which picture was hit first for each illuminated light in the series and in this embodiment constituting a latching circuit comprising the cross-connected NAND gates 106A and 106B (comprising a 7400 integrated circuit). The latching circuit determines whether the "A" signal or the "B" signal was first and then provides the appropriate "turn-on" signal to the proper NAND gate 104A or 104B so that only the first signal can pass to the remainder of the circuit including means for totalling the score of such first hits for each participant. The latching circuit biases off the other NAND gate 104A or 104B so that no further signal results from the "second" pulse.

The "first" pulse then activates means for sounding a score. In this embodiment either sound unit 108A or 108B will isssue an appropriate groan, moan or "ug" as previously described upon receiving a "first pulse" from NAND gates 104A or 104B respectively. Each "first" pulse is also applied to a respective binary-coded-decimal (BCD) COUNTER 110A or 110B (typically a 7490 integrated circuit) of the score totalling means where the score of each player is accumulated. The outputs of the BCD COUNTERS 110A and 110B are fed to their respective BCD DECODERS 112A and 112B (typically 7447 integrated circuits) which in turn drive corresponding SCORE DISPLAYS 114A and 114B made of seven segment readout devices that appear as score indicator 30 in FIG. 1.

Since the contest is more interesting if a winner is declared, means for comparing the scores of the participants and identifying a winner are provided. An output from each BCD COUNTER 110A and 110B is fed to an input of BINARY COMPARATOR 116 (typically a bank of 7485 integrated circuits). After a predetermined period of play has elapsed and the game has ended, the scores for the "A" and "B" players are compared. If the "A" score is greater the COMPARATOR 116 causes "WINNER" light 118A to illuminate as shown at light 32 in FIG. 1. Correspondingly, a victory by "B" would cause "WINNER" light 118B to illuminate.

In order to sequence the lamps L1A...LϕA and L1B...LϕB, a novel pseudo-random light driver circuit is provided. An output signal from each 100 MILLISECOND PULSE GENERATOR 102A and 102B is also fed to a respective input of NOR gate 120 (typically a 7402 integrated circuit) which in turn drvies a 10 MILLISECOND PULSE GENERATOR 122 (typically comprising a 555 integrating circuit in a pulse generating, monostable circuit) which provides sharp triggering pulses. These triggering pulses are applied to the input terminal of an UP/DOWN BINARY COUNTER 124 (typically a 74190 integrated circuit). The ripple clock output of the COUNTER 124 generates a pulse with every $\phi$ count and is connected to the input of a DIVIDE BY 2 ($\div$ 2) circuit 126 (comprising a 74107 integrated circuit) which, in turn, is connected to the UP/DOWN input of the COUNTER 124. The four outputs of the COUNTER 124 are then fed to a BCD/DECIMAL CONVERTER 128 which drives the lamps L1A...LϕA and L1B...LϕB through Darlington amplifiers (not shown) to cause the corresponding lights in both series to be illuminated and extinguished at the same time. Each time a pulse appears at the input of the NOR gate 120, the UP/DOWN BINARY COUNTER 124 changes its stored count by $\pm$ 1, depending on the signal appearing at the UP/DOWN input. This, in turn, causes another one of each of the lamps L1A...LϕA and L1B...LϕB to light. Whether the COUNTER 124 counts up or down depends on the input of the $\div$ 2 circuit 126. That circuit counts the number of pulses received from the COUNTER 124 and reverses the logical sign of its binary output signal on every other pulse. Thus the series in which the lamps are illuminated contains the sequence ...1, 2, 3, 4, 5, 6, 7, 8, 9, $\phi$, 1, $\phi$, 9, 8, 7, 6, 5, 4, 3, 2, 1, $\phi$, 1, 2, ... with the shift from counting down to counting up coming at the sequences ...$\phi$, 1, $\phi$... and ...1, $\phi$, 1... . Although random signal generators or other pseudo-random signal generators can be used, this pseudo-random signal is preferred because it performs well in play and because this low-cost and high-reliability circuit is easily checked for proper performance in the field by stepping through its known sequence.

Because a defective lightbulb or microswitch could disable the amusement device in the field, an automatic advancing circuit is included to provide an input to the COUNTER 124 in the event pulses are not normally received. OR gate 130 has an input connected to each of the PULSE GENERATORS 102A and 102B. The output of OR gate 130 is connected to 2 SECOND DELAY AND PULSE GENERATOR 132. GENERATOR 132 will issue an output pulse to COUNTER 124 every two seconds unless its input is reset by a signal coming from OR gate 130. Thus if a bulb or microswitch is defective (particularly in the single player mode) and no signal issues from either generator 102A or 102B, the DELAY & PULSE GENERATOR 132 will wait two seconds from the time the last pulse was received and then cause COUNTER 124 to index by $\pm$ 1.

As noted earlier, the game is activated by the insertion of coins in the slots 38. These coins then pass into COIN ACCEPTOR 140 which measures their value and tests for counterfeits. In the United States, the COIN ACCEPTOR 140 is designed to issue one output pulse for each quarter ($0.25) received. If only one quarter is received, only one side ("A" or "B") is energized and the amusement device becomes a "one player" game in which the participant seeks to obtain the highest possible score during the alotted time of 30 or 60 seconds. If two quarters are received, then both sides ("A" and "B") are energized and the amusement device becomes a "two player game" for competition between the participants.

Upon registering a coin, the coin acceptor 140 issues a pulse to reset counters 110A and 110B back to zero and to start the 5 SECOND "GET READY" DELAY CIRCUIT 142 which then energizes "GET READY" light 144A and 144B (shown as light 28 in FIG. 1) for 5 seconds. As noted earlier, this period gives the participants time to position themselves in front of their respective combatants 26 and to focus their attention on the game. At the end of the period, the 5 SECOND "GET READY" DELAY CIRCUIT 142 extinguishes the "GET READY" lights 144A and 144B and energizes "GET READY" SOUND GENERATOR 146 which, in turn, issues a noise such as a grunting sound, bell or gong that signals the beginning of the match. A "RUN" signal is also sent to RUN/STOP LATCHING CIRCUIT 150, comprising cross-coupled NAND gates 150R and 150S, to trigger NAND gate 150R to "ON" thereby generating a "RUN" signal which, in turn, is transmitted to other portions of the circuit (by connections not shown) to cause their activation.

For coin-operated games, means for terminating play after a predetermined time are required. In the embodiment, timing of the game is controlled by GAME TIMER 152 comprising 1 HERTZ CLOCK GENERATOR 154, OR gate 156, NAND gate 158 and DIVIDE BY 30/60 ($\div$ 30/60) circuit 160 (typically including a 7490 integrated circuit). One hertz pulses from CLOCK GENERATOR 154 are applied to one of the inputs of OR gate 156. During the 5 second "GET READY" period, DELAY CIRCUIT 142 transmits a "WAIT" pulse to the other input of the OR gate 156 and this prevents the 1 hertz clock pulses from being duplicated at the output of the OR gate 156. At the end of the 5 second period, 1 hertz pulses are fed from the output of the OR gate 156 to an input of NAND gate 158. If a "RUN" signal appears at the other input of NAND gate 158 because NAND gate 150R has been triggered "ON", 1 hertz pulses will be transmitted from the output of NAND gate 158 to the input of the DIVIDE BY 30/60 CIRCUIT 160. This circuit will divide the input pulses by either 30 or 60 (at the owner's selection) so that an output pulse will issue for every 30 or every 60 input pulses -that is, every 30 or 60 seconds. That output pulse is then applied to an input of TIE BREAKER NAND GATE 162 which in this embodiment is included in means for continuing play after the predetermined playing time has elapsed when the participants' scores are equal.

If the score is not tied at the end of the playing period (30 or 60 seconds), then the receipt of an output pulse from the DIVIDE BY 30/60 CIRCUIT 160 will cause TIE BREAKER NAND GATE 162 to issue a triggering pulse to NAND gate 150S, thereby switching the RUN/STOP latching circuit 150 to the "STOP" mode. If there is a tie at the end of the playing period, COMPARATOR 116 will issue an A=B pulse signal to the other input of TIE BREAKER NAND gate 116 to prevent that gate from issuing a "TURN-OFF" pulse until either "A" or "B" scores another "hit" in a "sudden-death" playoff.

The preferred embodiment of the amusement device of this invention is one adapted for two-player, coin-operated applications. In some applications, a single player game may be desired and such a modification can be achieved by eliminating the second combatant 26 and those portions of the electronic circuitry which are only needed to accomodate the second player. This would include switches 1B...$\phi$B, lights, L1B...L$\phi$B, NAND gates NB1...NB$\phi$, NOR gate 100B and the elements 104A, 104B, 106A, 106B, 108B, 110B, 112B, 114B, 116, 118B and 144B. Gates 120 and 130 would be replaced by jumpers from the output of PULSE GENERATOR 102A to the inputs of GENERATORS 122 and 132. Similarly, TIE BREAKER NAND gate 162 would be unnecessary and could be replaced by a jumper between the output of circuit 160 and the input of gate 150S.

Another adaptation for either a one-player or a two-player game incorporates means for terminating play after a participant has achieved a predetermined score or number of "hits". Instead of comparing the "A" and "B" scores with COMPARATOR 166 as shown in FIG. 4, the alternative circuit in FIG. 5 uses COMPARATORS 116A' and 116B' to compare the scores in BCD COUNTERS 110A' and 110B' with a predetermined number M stored in BINARY MEMORY 170. When the first participant has scored M "hits", a pulse will appear on either of the output lines A=M or B=M and turn on the respective "WINNER" light 118A' or 118B'. The pulse will also pass through OR gate 172 and can be applied to the input of RUN/STOP NAND gate 150S to stop the game. With this modification, elements 154, 156, 158, 160 and 162 are unnecessary and can be removed. For a one-player version, elements 110B', 116B', 118B' and 172 are unnecessary as the output line A=M can be connected to the input of the NAND gate 150S to stop the game.

The basic logic of the electronic circuitry has been described in full detail. Illustrations of specific timing, biasing, pulse shaping circuits and the like have been avoided as none of these relate to the invention and are simply matters of designers' choice for the type of integrated circuit logic selected. Integrated circuits known as the 7400 series and the 555 timer circuit have been selected for the preferred embodiment because of their low cost. A complete description of these elements may be found in the Signetics Digital, Linear, MOS integrated Circuits Data Book copyrighted in 1974 by Signetics Corporation of Menlo Park, California 94025. Through the use of other logical elements, a wide variety of amusement devices can be made within the spirit and scope of this invention.

What is claimed is:

1. An amusement device comprising:

a first picture of a combatant adapted to be hit by a participant;

a first series of lights mounted and camouflaged behind the surface of the picture so that their positions can only be seen when they are illuminated;

first detecting means for detecting when the picture is hit in the vicinity of a light in the first series; and illuminating means responsive to the detecting means for illuminating said lights one at a time and for controlling which light in the series is next illuminated when the picture is hit in the vicinity of an illuminated light.

2. The amusement device of claim 1 wherein the picture is offset at approximately a 7° angle with respect to a vertical plane.

3. The amusement device of claim 1 wherein the series of lights comprises 10 lights.

4. The amusement device of claim 1 wherein the illuminating means includes a random signal generator for selecting which light will next be illuminated, whereby the lights are illuminated in a random sequence.

5. The amusement device of claim 1 wherein the illuminating means includes a psuedo-random signal generator for selecting which light will next be illuminated, whereby the lights are illuminated in a psuedo-random sequence.

6. The amusement device of claim 5 wherein the generator provides a psuedo-random signal which includes the series:

...$\phi$, 1, $\phi$...

whereby the lights are illuminated in a sequence including this series.

7. The amusement device of claim 5 wherein the generator provides a psuedo-random signal which includes the series:

...1, $\phi$, 1...

whereby the lights are illuminated in sequence including this series.

8. The amusement device of claim 7 wherein the series of lights consists of 10 lights.

9. The amusement device of claim 8 wherein the generator provides a signal which includes the series:

...1,2,3,4,5,6,7,8,9,$\phi$,1,$\phi$,9,8,7,6,5,4,3,2,1,$\phi$,1,2,...

whereby the lights are illuminated in a sequence including this series.

10. The amusement device of claim 1 wherein the means for detecting when the picture is hit comprise:

a button biased against the picture in a location contiguous to a light.

11. The amusement device of claim 10 wherein the button is made of a translucent material and transmits the illumination from an adjacent light to the picture when the light is energized.

12. The amusement device of claim 10 comprising in addition:

a switch activated by the movement of the button.

13. The amusement device of claim 1 wherein the illuminating means includes:

means for extinguishing a light in the vicinity of the area in which the picture was hit.

14. The amusement device of claim 1 comprising in addition:

means for sounding a score.

15. The amusement device of claim 1 comprising in addition:

a second picture;

a second series of lights mounted behind the second picture;

second detecting means for detecting when the second picture is hit in the vicinity of a light in the second series; and wherein the illuminating means are:

responsive to the second detecting means for illuminating said lights in said second series one at a time and for controlling which light in the second series is next illuminated when the second picture is hit in the vicinity of an illuminated light.

16. The amusement device of claim 15 wherein the pictures are substantially identical.

17. The amusement device of claim 16 wherein the lights in each series are mounted in identical positions behind their respective pictures.

18. The amusement device of claim 17 wherein the illuminating means cause the corresponding lights in both series to be illuminated and extinguished at the same time.

19. The amusement device of claim 15 wherein each picture illustrates a combatant.

20. The amusement device of claim 18 wherein each picture is set at approximately a 7° angle with respect to a vertical plane.

21. The amusement device of claim 20 wherein the angle between the pictures is approximately 14°.

22. The amusement device of claim 15 wherein each series of lights is camouflaged behind the surface of its respective picture so that the positions of the lights can be seen only when they are illuminated.

23. The amusement device of claim 15 wherein each series of lights contains 10 lights.

24. The amusement device of claim 15 wherein each picture illustrates a combatant and each series of lights consists of 10 lights camouflaged behind the surface of the picture of their respective combatant so that the position of the lights can be seen only when they are illuminated.

25. The amusement device of claim 15 comprising in addition:

means for determining which picture was hit first for each illuminated light in the series; and means for totaling the score of such first hits for each participant.

26. The amusement device of claim 25 comprising in addition:

means for comparing the scores of the participants and identifying the winner.

27. The amusement device of claim 26 wherein the score comparing means determines the winner after a predetermined period of play has elapsed.

28. The amusement device of claim 25 comprising in addition:

means for terminating play after a participant has achieved a predetermined score.

29. The amusement device of claim 15 comprising in addition:

means for sounding a score.

30. The amusement device of claim 15 further including means for sounding a grunt when a picture has been hit in the immediate vicinity of an illuminated light.

31. The amusement device of claim 1 wherein the picture comprises a flexible sheet and the detecting means comprise a movable element behind the sheet and adjacent to a light.

32. The amusement device of claim 31 further including a soft resilient cushion behind the sheet and around the movable element.

33. The amusement device of claim 1 wherein the picture is relatively soft and resilient in the vicinity of the lights.

34. The amusement device of claim 1 further including means for sounding a grunt when the picture has been hit in the immediate vicinity of an illuminated light.

35. An amusement device for simulating competition in the martial arts comprising:

a pair of substantially identical pictures of a combatant, each picture set at an angle with respect to a vertical plane;

two series of lights, each series of lights camouflaged behind the surface of its respective picture such that the positions of the individual lights can only be seen when they are illuminated;

means for detecting when a picture has been hit in the immediate vicinity of a light;

switching means for extinguishing a light in each series and for illuminating another light in each series each time either picture is hit in the vicinity of an illuminated light;

means for determining which picture has hit first for each illuminated light in the series; and means for totaling the score of such first hits for each participant.

36. The amusement device of claim 35 wherein the pictures are set at approximately a 14° angle with respect to each other.

37. The amusement device of claim 35 wherein each series of lights comprises 10 lights.

38. The amusement device of claim 35 wherein the switching means includes a psuedo-random signal generator for selecting which light will next be illuminated, the generator providing a signal which includes:

the series $\ldots\phi,1,\phi\ldots$ and the series $\ldots 1,\phi,1\ldots$ , whereby the lights are illuminated in a sequence containing both of these series.

39. The amusement device of claim 35 comprising in addition:

means for terminating play after a predetermined time; and means for comparing the participants' scores and determining the winner.

40. The amusement device of claim 39 comprising in addition:

means for continuing play after the predetermined time has elapsed when the participants scores are equal.

41. The amusement device of claim 35 comprising in addition:

means for terminating play after a participant has achieved a predetermined score.

42. The amusement device of claim 35 comprising in addition:

means for sounding a score.

43. The amusement device of claim 35 further including means for sounding a grunt when a picture has been hit in the immediate vicinity of an illuminated light.

* * * * *